US010506859B2

(12) United States Patent
Putzer et al.

(10) Patent No.: US 10,506,859 B2
(45) Date of Patent: Dec. 17, 2019

(54) HAIR CARE DEVICE

(71) Applicant: KONINKLIJKE PHILIPS N.V., Eindhoven (NL)

(72) Inventors: Arthur Putzer, Eindhoven (NL); Tamara Eberharter, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 192 days.

(21) Appl. No.: 14/774,215

(22) PCT Filed: Feb. 13, 2014

(86) PCT No.: PCT/EP2014/052840

§ 371 (c)(1),
(2) Date: Sep. 10, 2015

(87) PCT Pub. No.: WO2014/173554

PCT Pub. Date: Oct. 30, 2014

(65) Prior Publication Data

US 2016/0174677 A1 Jun. 23, 2016

Related U.S. Application Data

(60) Provisional application No. 61/843,499, filed on Jul. 8, 2013.

(30) Foreign Application Priority Data

Apr. 25, 2013 (EP) ..... 13165257

(51) Int. Cl.

| | |
|---|---|
| ***A45D 2/42*** | (2006.01) |
| ***A45D 2/00*** | (2006.01) |
| ***A45D 1/04*** | (2006.01) |

(52) U.S. Cl.
CPC ..... *A45D 2/002* (2013.01); *A45D 1/04* (2013.01); *A45D 2/001* (2013.01); *A45D 2001/045* (2013.01)

(58) Field of Classification Search
CPC ... A45D 1/00; A45D 1/02; A45D 1/04; A45D 1/06; A45D 1/08; A45D 1/14; A45D 1/18;

(Continued)

(56) References Cited

U.S. PATENT DOCUMENTS 4,492,241 A * 1/1985 Thaler ..... A45D 1/04 132/229
5,865,188 A * 2/1999 Marquez ..... A45D 2/001 132/132

(Continued)

FOREIGN PATENT DOCUMENTS

CH 702861 A1 9/2011
CN 202104406 U 1/2012

(Continued)

*Primary Examiner* — Rachel R Steitz

(57) ABSTRACT

The present invention relates to a hair care device (10) for straightening, curling and/or volumizing hair, the hair care device comprising: —a first jaw (12) that extends along a first longitudinal axis (30) and comprises a first handle part (16) which is coupled to a first heating tip (20), wherein the first heating tip (20) has a convex-shaped first heating surface (34), and distance elements (36, 40) to prevent a user from getting burned, preferably a bristle plate (36) that comprises a plurality of bristles or ribs (40), wherein the distance elements are arranged at a side (38) of the first heating tip (20) opposite the convex-shaped first heating surface (34), and wherein the first heating tip (20) is rotatably coupled to the first handle part (16) to permit a user to rotate the first heating tip (20) relative to first handle part (16) about the first longitudinal axis (30) —a second jaw (14) that extends along a second longitudinal axis (32) and (Continued)

comprises a second handle part (18) which is coupled to a second heating tip (22); and wherein the first and the second jaw (12, 14) are coupled to each other, and via the handle parts (16, 18) moveable relative to each other between an open position and a closed position.

16 Claims, 10 Drawing Sheets

(58) Field of Classification Search
CPC ..... A45D 2001/004; A45D 2001/045; A45D 2/002; A45D 2/00
See application file for complete search history.

(56) References Cited

U.S. PATENT DOCUMENTS 6,070,596 A * 6/2000 Altamore ..... A45D 1/06 132/224
6,627,852 B1 9/2003 Savone
6,920,886 B2 * 7/2005 McCambridge ..... A45D 2/001 132/232
7,045,744 B2 * 5/2006 Oh ..... A45D 1/10 219/225
8,146,605 B1 * 4/2012 Laaly ..... A45D 1/04 132/118
9,049,913 B2 * 6/2015 Chan ..... A45D 1/04
D735,477 S * 8/2015 Anderson ..... D4/116
2005/0076930 A1 * 4/2005 Yuen ..... A45D 2/002 132/132
2005/0236009 A1 * 10/2005 Park ..... A45D 1/18 132/224
2006/0076032 A1 * 4/2006 Fung ..... A45D 1/06 132/224
2007/0033754 A1 * 2/2007 Diamond ..... A46B 5/0012 15/106
2011/0226278 A1 * 9/2011 Rivola ..... A45D 2/001 132/232
2012/0272994 A1 11/2012 Sayers

FOREIGN PATENT DOCUMENTS

GB 1519930 A 8/1978
JP 2005237803 A 9/2005
KR 100866493 B1 11/2008
KR 20120035601 A 4/2012
WO 0049906 A2 8/2000

* cited by examiner

HAIR CARE DEVICE

This application is the U.S. National Phase application under 35 U.S.C. § 371 of International Application No. PCT/EP2014/052840, filed on Feb. 13, 2014, which claims the benefit of European Application No. 13165257.0 filed on Apr. 25, 2013 and U.S. Provisional Application 61/843,499 filed Mar. 5, 2013. These applications are hereby incorporated by reference herein.

FIELD OF THE INVENTION

The present invention relates to the field of hair care and hair styling. In particular, the present invention relates to a hair care device for straightening, curling and/or volumizing hair.

BACKGROUND OF THE INVENTION

Hair styling appliances are generally known and include hair straighteners, hair curlers, hot combs and devices for volumizing hair.

Hair straighteners, which are sometimes also referred to as hair irons, are used to straighten the hairs. These hair straighteners usually comprise two jaws which are hinged in order to pinch a strand of hair. Each jaw comprises a structured or unstructured plate (herein also referred to as heating tip or heating barrel), one or both of which are heated directly or indirectly by means of a heater. An additional heat control system may be applied to regulate the temperature of one or both plates. The hair straightener is usually either powered by main supplied electricity or battery-driven.

To straighten the hairs, a strand of hair is inserted into the hair straightener, wherein it is pinched between the two heating tips (heated plates). The two jaws of the hair straightener may thereto be moved from an open position, in which the two jaws are spaced apart from each other, to a closed position, in which the two jaws at least partly contact each other. A hinge is usually provided at the rare end of the hair straightener. This hinge couples the two jaws with each other to permit a user to swivel at least one of the jaws around a hinge axis between the open and the closed position.

Hair curlers usually comprise a heated cylindrically shaped curling iron tip around which a hair strand can be wrapped to impart a curl. These hair curlers may either comprise a handle and have a similar form as hair straighteners in order to manually curl the hair, hair strand by hair strand, or the user is provided with a set of a plurality of hair curling elements that are directly fixated on the head of the user via a clamp with the hairs wrapped around it.

Most of the known prior art hair styling devices are specialized devices, specifically specialized for straightening, curling or volumizing. Users therefore have to have a plurality of different hair styling devices, one device for each specialized hair styling appliance. This is of course not only costly, but also takes up a lot of room e.g. in the private bathroom.

GB 1 519 930 describes a portable electrical hairdressing appliance which can be used either (a) as a curling or waving appliance or (b) to straighten the hair by enabling the curl or wave to be removed if necessary. The appliance comprises two heater units each having one surface provided with corrugations and the opposite surface smooth, means being provided to bring either the two corrugated surfaces or the two smooth surfaces into contact. The corrugations of the two surfaces match one another. The heater unit is changed from one position to another by pivoting it manually through 180°.

U.S. Pat. No. 6,627,852 B1 discloses a curling iron with rotatable asymmetrical heating tips. This curling iron allows curling and straightening hairs with one and the same device. It so to say provides a two-in-one solution. The user may change the device set up from a curling mode to a straightening mode, and vice versa, by rotating one of the asymmetrical heating tips around a rotational axis lengthwise along the handle length. Users may therefore easily alternate between straightening hair and curling hair while still using the same device.

However, there is still room for improvement. Even though the above-mentioned device known from U.S. Pat. No. 6,627,852 B1 allows to curl and straighten hairs with the same device, this device does not allow to be applied for still other ways of hair styling, such as e.g. for volumizing the hairs.

SUMMARY OF THE INVENTION

It is an object of the present invention to provide an alternative and further improved hair care device. The invention is defined by the independent claim. Preferred embodiments of the invention are defined in the dependent claims.

One embodiment of the invention provides a hair care device for straightening, curling and/or volumizing hair, the hair care device comprising:

a first jaw that extends along a first longitudinal axis and comprises a first handle part which is coupled to a first heating tip, wherein the first heating tip has a convex-shaped first heating surface, wherein the first heating tip is rotatably coupled to the first handle part to permit a user to rotate the first heating tip relative to first handle part about the first longitudinal axis;

a second jaw that extends along a second longitudinal axis and comprises a second handle part which is coupled to a second heating tip, wherein the first and the second jaw are coupled to each other and via the handle parts moveable relative to each other between an open and a closed position; and characterized by a bristle plate that comprises a plurality of bristles or ribs, wherein said bristle plate is arranged at a side of the first heating tip opposite the convex-shaped first heating surface.

An embodiment may be used for even more ways of different hair styling. In a preferred embodiment, the hair care device should be suitable for straightening, curling and volumizing hairs. An increased volume at the hair roots can be achieved as well as a good straightening and curling performance with just one device and without any extra attachments. In that embodiment, the hair care device provides a three-in-one solution. It allows straightening, curling and volumizing hair with one and the same device. The user only has to slightly modify the setup in a mechanically easy manner between a straightening mode, a curling mode or a volumizing mode. Only a few modification steps are thereto required.

The hair care device in accordance with the invention is generally built up like a hair straightener with two jaws that are coupled to each other and movable relative to each other between an open and a closed position using two different handle parts, one handle part arranged at each jaw. Similar as the device shown in U.S. Pat. No. 6,627,852 B1, one of the heating tips, which is herein denoted as first heating tip, is rotatably coupled to the corresponding handle part of the same jaw (herein denoted as first handle part of the first jaw) to permit a user to rotate the first heating tip relative to the first handle part about the first longitudinal axis. This allows a user to switch between a straightening mode and a curling mode by rotating the first heating tip.

In deviation therefrom, the device in accordance with a preferred embodiment of the present invention comprises a bristle plate having a plurality of bristles or ribs that may act as distance elements to a scalp of a user. This bristle plate is arranged at a rare side of the first heating tip that is arranged on the opposite side at which the convex-shaped first heating surface is arranged that is used for straightening and curling.

In the volumizing mode, a user may contact the scalp with the bristles arranged on the bristle plate while guiding the hair strand to be volumized over the second heating tip of the second jaw. The bristles thereby act as a kind of scalp heat protection and prevent a user from getting burned by one of the heating tips. Consumers may therefore easily hold the device closer to the scalp without danger to get burned. This significantly simplifies creating hair volume from the hair roots on. It shall be noted that instead of bristles, also ribs, knobs or any other distance elements may be used for this kind of heat protection function.

The bristle plate preferably comprises a plurality of bristles or ribs that are arranged in an array to form an imaginary planar surface similar as a bed of nails. Instead of using small pin-like bristles, also straight ribs could be used that are arranged on the bristle plate in a crosswise manner. The described imaginary surface that is formed by the bristles of the bristle plate may also be concave. This may be accomplished by bristles of different lengths or by providing a concave ground plate on which the bristles/ribs are arranged.

According to an embodiment, the first heating tip is rotatable relative to the first handle part about the first longitudinal axis between a first position, in which the bristle plate faces towards the second heating tip, and a second position, in which the bristle plate faces away from the second heating tip.

In order to change the first heating tip from the first to the second position, the first heating tip is preferably rotated by 180° around the first longitudinal axis.

The first position may be used for curling. In this position, the convex-shaped first heating surface, which is arranged at the top side of the first heating tip, builds the outer surface of the hair care device. Said first heating surface is preferably a sleek round or semi-circular surface. If the jaws are then brought to the closed position, hairs may be wrapped around the two heating tips in order to create hair curls.

If the first heating tip is brought into its second position, the presented hair care device may be either used for straightening or for volumizing. In this second position, the bristle plate faces outwards, while the convex-shaped first heating surface of the first heating tip faces inwards towards the second heating tip.

For straightening the hairs, a hair strand may be then pinched between the first heating tip and the second heating tip, that is between the convex-shaped first heating surface and the heating surface of the second heating tip (herein denoted as third heating surface, see below).

For creating hair volume from the hair roots, the bristle plate may be in the second position of the first heating tip, contacting the scalp of the user while the treated hair strand is guided over the second heating tip in order to heat the hair strand and create an increased hair volume.

Straightening, curling and volumizing is all done in the closed position of the jaws. Especially for curling and volumizing, this closed position of the jaws may be locked by a simple mechanical locking mechanism. The difference in the device setup for the different hair styling appliances is only the position of the first heating tip. Curling is done in the first position of the first heating tip, while straightening and volumizing is performed in the second position of the first heating tip.

The first heating tip preferably has a crescent shaped cross-section. On the semicircular top side the sleek first heating surface is arranged, while the bristle plate is arranged at and connected to the planar bottom side. As already mentioned above, the bristle plate is "only" used for volumizing the hairs (in the second position of the first heating tip), while the sleek semi-circular first heating surface may be, depending on the position of the first heating tip, either used for curling (first position) or for straightening (second position).

It shall be noted that the terms "first", "second" and "third" do not relate to the overall number of the specific parts, but are herein used to differentiate between similar or corresponding parts of the device in accordance with the invention.

According to a further embodiment, the second heating tip comprises:

a convex-shaped second heating surface at a side that faces away from the first heating tip; and a third heating surface that faces towards the first heating tip and has at least in part a concave-shaped contour that matches an outer contour of the first heating surface of the first heating tip.

As it will become more apparent from the accompanying drawings and the detailed description of the drawings, the convex-shaped second heating surface preferably has a similar shape as the first heating surface that is arranged at the first heating tip. This second heating surface may either be used for curling or for volumizing the hairs. In the straightening mode, the hair strand is pinched between the first heating surface of the first heating tip and the third heating surface of the second heating tip. Since the third heating surface has a concave-shaped contour that matches the outer contour of the first heating surface, the hairs may be straightened in an optimal way. The rounded concave/convex heating surfaces that match each other, compared to flat heating surfaces, create an enlarged heating area that results in an improved straightening performance. Even more important is that the mating concave/convex heating surfaces create an increased resistance on hairs pinched between them. This additionally improves the straightening performance compared to hair straighteners with flat heating surfaces. However, it is to be noted that preferably only a part of the third heating surface, e.g. the middle part, has a concave shape. The lateral parts of the third heating surface are preferably flat. This prevents an unwanted kinking of the hairs.

According to a further preferred embodiment, the hair care device further comprises at least one mechanical end stop element that is configured to keep the bristles or ribs of the bristle plate at distance from the second heating tip when the first heating tip is in the first position and the jaws are in the closed position.

This mechanical end stop element prevents the bristle plate from getting into contact with the second heating tip (with the third heating surface). Otherwise, the bristle plate could be damaged due to the high temperature of the second heating tip. In this way, the bristle plate does not become too hot. When turning the first heating tip from its first to its second position, the heating tips may thus immediately contact the scalp of the user during volumizing the hairs without a risk of burning the user's scalp.

According to a further embodiment, the first jaw comprises a first grip element at a free end of the first heating tip to permit a user to rotate the first heating tip relative to the first handle part, wherein said free end of the first heating tip is opposite the end at which the first heating tip is connected to the first handle part.

Said first grip element is preferred to be thermally insulated from the first heating tip and comprises a temperature-resistant synthetic material.

Users may thus easily rotate the first heating tip between the first and the second position by using the above-mentioned first grip element. This grip element may be shaped in various ways. Preferably, it has an ergonomic shape to increase the user comfort. It is preferably arranged at the distal end of the first jaw and extends along the first longitudinal axis. Due to the thermal insulation of said grip element, there is no danger for the user to get burned.

According to a further preferred embodiment, the second jaw also comprises such a grip element. This grip element shall be herein denoted as second grip element, which is arranged at the free end of the second heating tip. The user may therefore hold both jaws at their free ends. This makes it a lot easier to rotate the first heating tip in a secure manner.

According to a further embodiment, the above-mentioned at least one mechanical end stop element is arranged at the first and/or second grip element. In this case, the grip elements have two functions: 1. means for rotating the first heating tip between its two positions; and 2. acting as mechanical end stop elements to prevent the bristle plate from getting into contact with the second heating tip if the first heating tip is in its first position and the jaws are brought to the closed position.

According to a further embodiment, the hair care device comprises a locking mechanism for preventing a rotation of the first heating tip relative to the first handle part, when the jaws are in the closed position. This prevents an unwanted rotation of the first heating tip during use. It fixates the first heating tip either in the first or in the second position and thereby mechanically defines the two positions in an accurate manner.

According to an embodiment, this is preferably realized in that the first and the second grip elements have matching outer contours, and in that the locking mechanism is realized by said matching outer contours that mate each other, when the first heating tip is in the second position and the jaws are in the closed position. Both grip elements may, for example, have a mating waved or corrugated shape. Extra parts for realizing the locking mechanism are in this case not needed.

As already mentioned in the beginning, the bristle plate builds one of the core features of the present invention. According to an embodiment, the bristle plate is thermally insulated from the first heating tip and comprises a temperature-resistant synthetic material.

Materials like polyamide may exemplarily be used. Polyamide or other plastics have very low heat conducting characteristics, which is of major advantage in this case. As already mentioned above, the bristle plate shall protect the user from getting burned during the volumizing mode. Since the heating tips become very hot during use (around 150° C. or above), a thermal insulation is advantageous. This may e.g. be done by arranging a thermally insulating intermediate layer between the bristle plate and the first heating tip.

A further aspect relates to the user comfort provided by said bristles or ribs. According to an embodiment, the bristles or ribs protrude from the bristle plate, wherein a multitude of said bristles or ribs is flexible and comprises a rounded free end. Of course, all bristles or ribs may be flexible and have a rounded free end. This serves for a lot more comfort for the user.

BRIEF DESCRIPTION OF THE DRAWINGS

These and other aspects of the invention will be apparent from and elucidated with reference to the embodiment(s) described hereinafter. In the following drawings

DETAILED DESCRIPTION OF EMBODIMENTS OF THE INVENTION

Figure 1A:
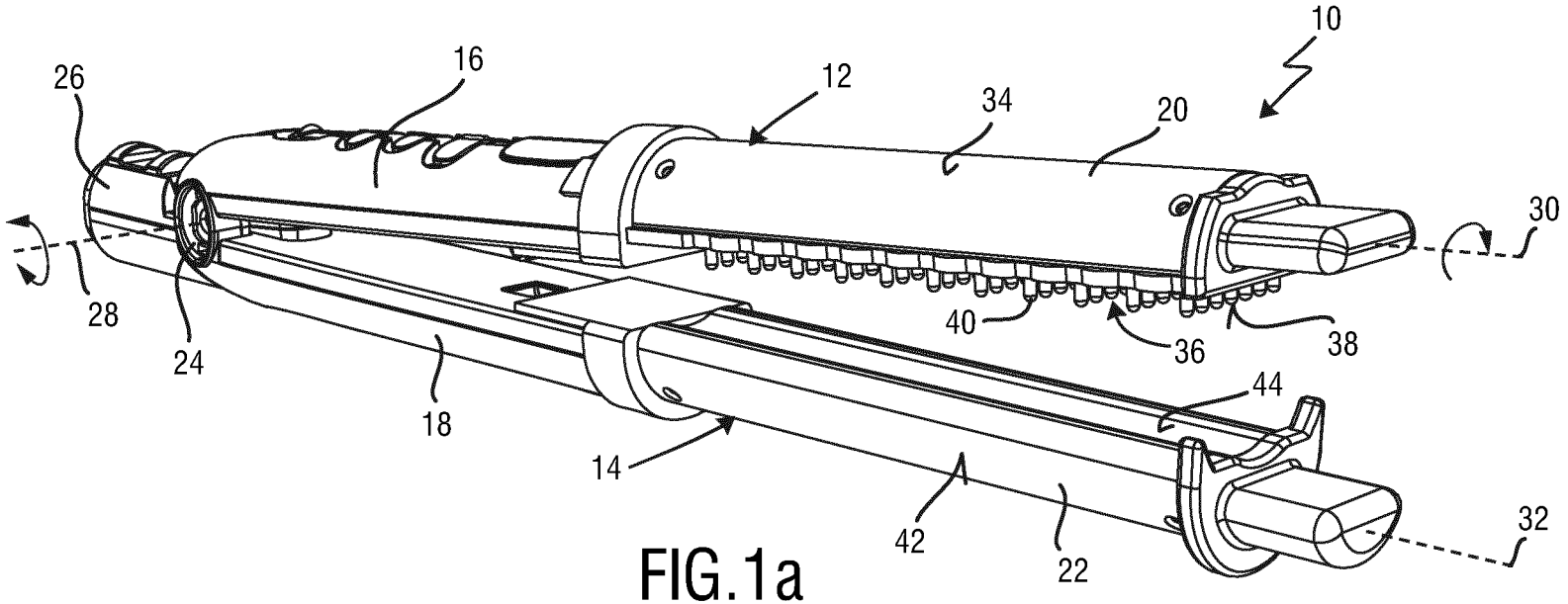
FIG. 1 shows an embodiment of the hair care device in open position in a perspective view (FIG. 1*a*) and a side view (FIG. 1*b*)
Figure 1B:
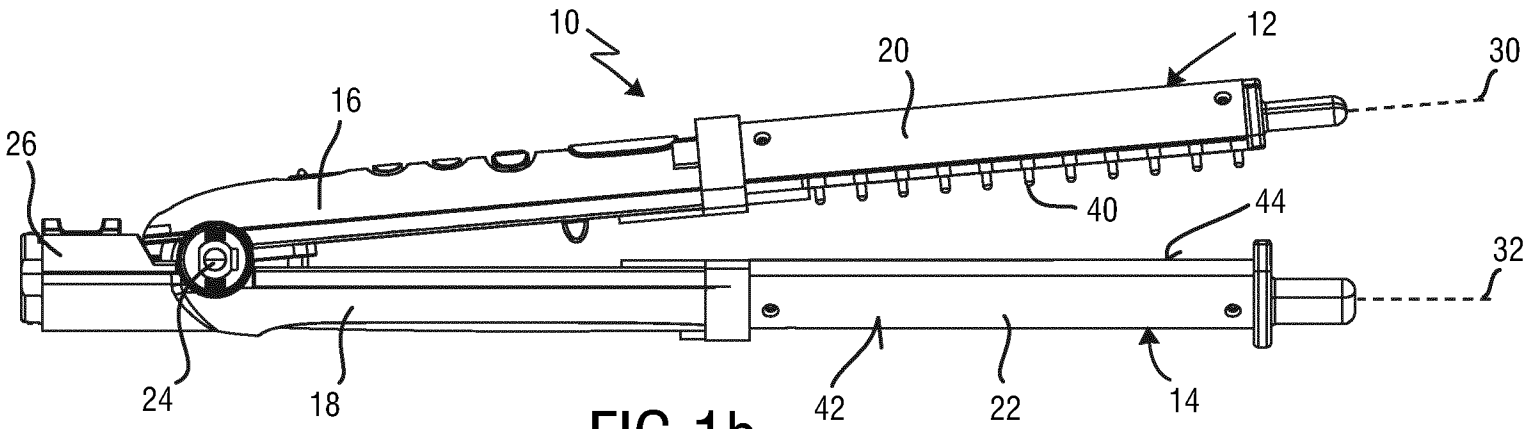

FIG. 1 shows an embodiment of the hair care device according to the present invention. The hair care device is therein in its entirety denoted with reference numeral 10.

The hair care device 10 comprises two jaws, a first jaw 12 and a second jaw 14. The first and the second jaw 12, 14 build the major housing parts of the device 10. Each jaw 12, 14 comprises a handle part 16, 18 and a heating tip 20, 22 that is coupled thereto. The first handle part 16 and the first heating tip 20 are arranged at the first jaw 12. The second handle part 18 and the second heating tip 22 are arranged at the second jaw 14. Both heating tips 20, 22 are herein also referred to as heating plates or heating barrels 20, 22.

Figure 2A:
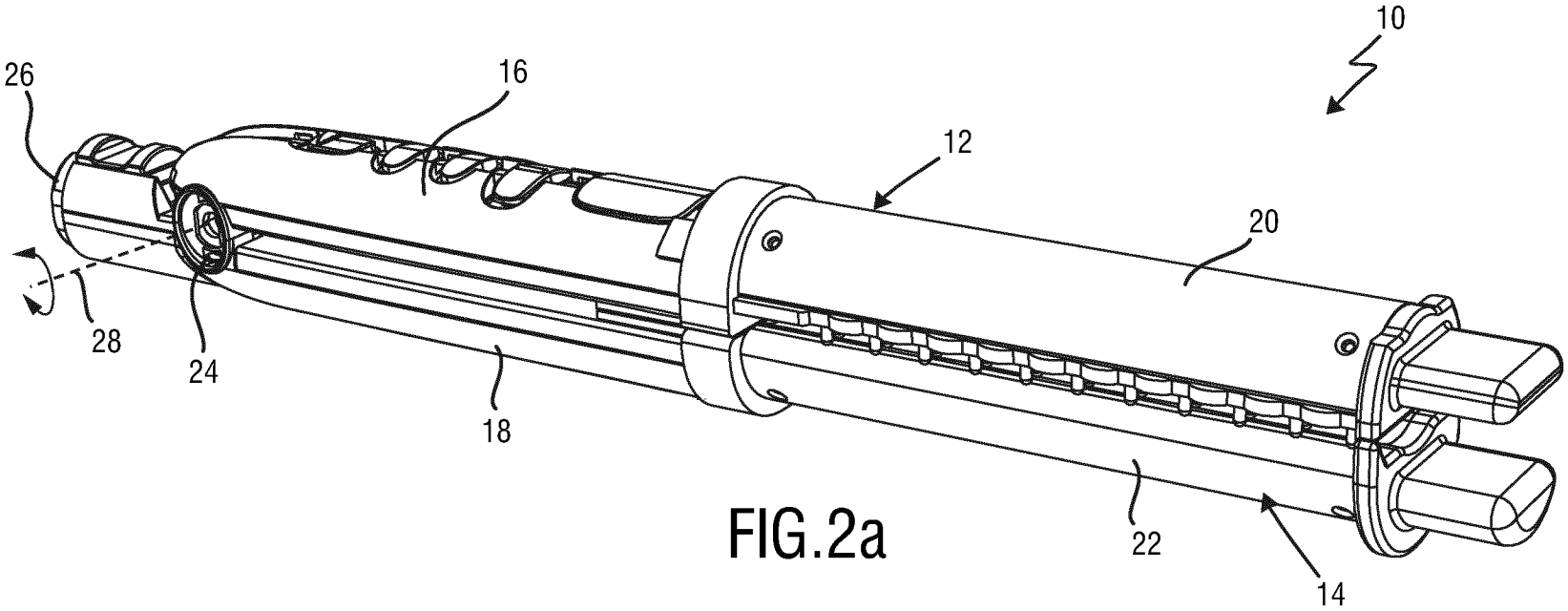
FIG. 2 shows the exemplary embodiment of the hair care device in closed position in a perspective view (FIG. 2*a*) and in a side view (FIG. 2*b*)

In the shown embodiment, the hair care device 10 is build up in a similar manner as a conventional hairs straightener. The two jaws 12, 14 are movable relative to each other between an open position (shown in FIG. 1*a, b*) and a closed position (shown in FIG. 2*a, b*). This is usually realized with a hinge 24 via which the two jaws 12, 14 are coupled. The hinge 24 is usually arranged at or near a rear end 26 of the device 10. The hinge 24 permits a user to swivel/pivot at least one of the jaws 12, 14 around a hinge axis 28. An additional spring element (not shown) may be provided that forces the two jaws 12, 14 into their open position (see FIG. 1*a, b*).

The two heating tips 20, 22 are heated by a heater (not shown). This heater is preferably integrated into the heating tips 20, 22. Heaters of this kind can be realized in many different ways. Usually an inductive heater or a PTC heater is used. These heaters can either be powered by main supplied electricity or battery-driven.

One of the central points of the present invention refers to the shape and functionality of the two heating tips 20, 22. Both heating tips 20, 22 have a generally crescent shaped cross section and substantially extend along a longitudinal axis. The first heating tip 20 substantially extends along a first longitudinal axis 30, along which also the first handle part 16 extends. The second heating tip substantially extends along a second longitudinal axis 32, along which also the second handle part 18 extends.

The first heating tip 20 comprises a convex-shaped first heating surface 34 at its top side. This first heating surface 34 is preferably a sleek surface. On the rear side 38 of the first heating tip 20 that is opposite the first heating surface 34 and faces away therefrom, the heating tip 20 comprises a bristle plate 36. This bristle plate 36 comprises a plurality of bristles or ribs 40 which act as distance elements, as this will be explained further below in detail.

The second heating tip 22 is preferably heated all around its peripheral surface. It comprises a convex-shaped second heating surface 42 that is arranged on the outer side and faces away from the first heating tip 12. On the opposite side that faces the first heating tip 20, it comprises a third heating surface 44. This third heating surface 44 preferably has at least in part a concave-shaped contour that matches with the outer contour of the first heating surface 34 of the first heating tip 20. The reasons for these matching contours will be elucidated below.

A further central point is the rotatability of the first heating tip 20. The first heating tip 20 is rotatable relative to the first handle part 16 about the first longitudinal axis 30. Depending on the type of hair styling that shall be achieved (hair straightening, hair curling or hair volumizing), the first heating tip 20 may be rotated between a first position (illustrated in FIG. 3) and a second position (illustrated in FIG. 4).

Figure 2B:
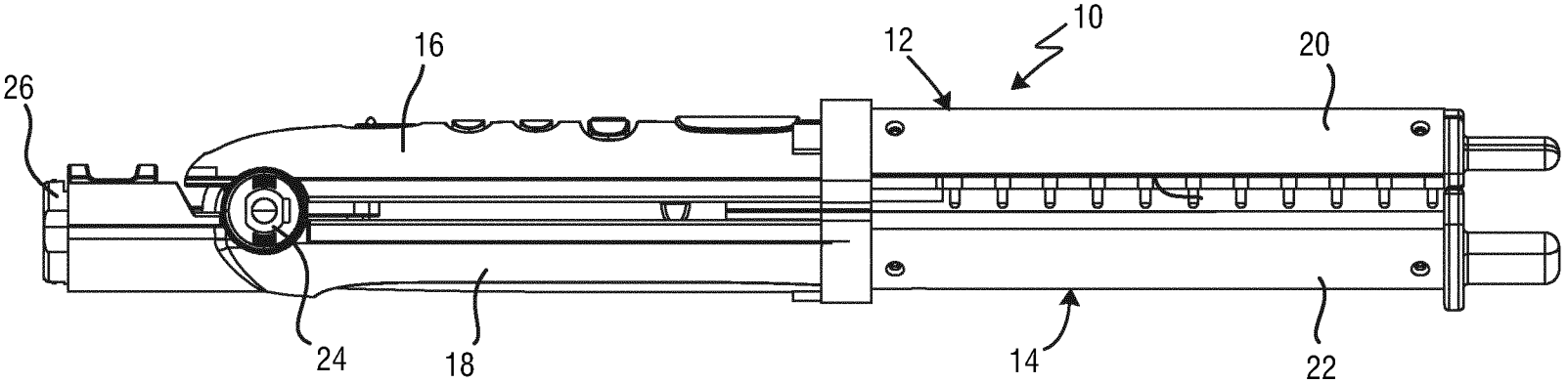
Figure 3A:
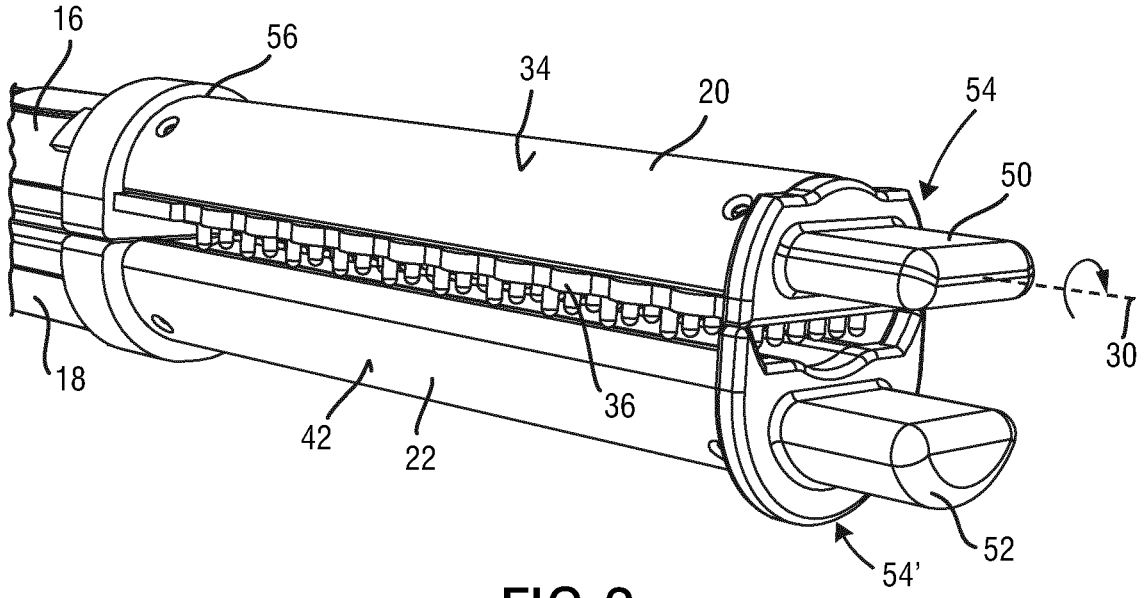
FIG. 3 shows enlarged views of the front portion of the hair care device in a first position.
Figure 3B:
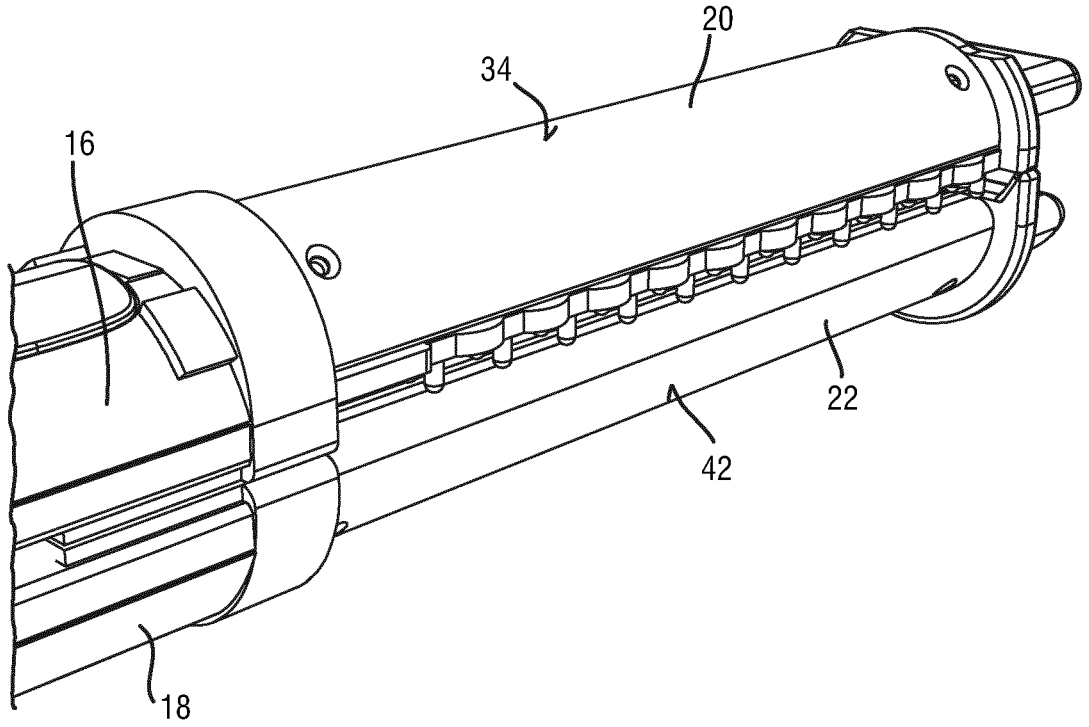

In the first position, which is illustrated in an enlarged view in FIGS. 3*a, b*, the first heating tip 20 is arranged such that the bristle plate 36 faces towards the second heating tip 22, in particular towards the third heating surface 44. The first heating surface 34 then faces upwards and builds an outer surface of the device 10. In this position of the first heating tip 20, the device 10 may be used as a hair curler. This is schematically illustrated in FIG. 6*b*. Since the device 10 in this case comprises two outer convex-shaped heated surfaces 34, 42, the hairs may be wrapped around these two surfaces in order to curl them. The jaws 12, 14 should in this case be closed. In order to facilitate the handling, a locking mechanism may be provided that allows the user to lock the jaws 12, 14 in their closed position (position shown in FIG. 2).

Figure 4A:
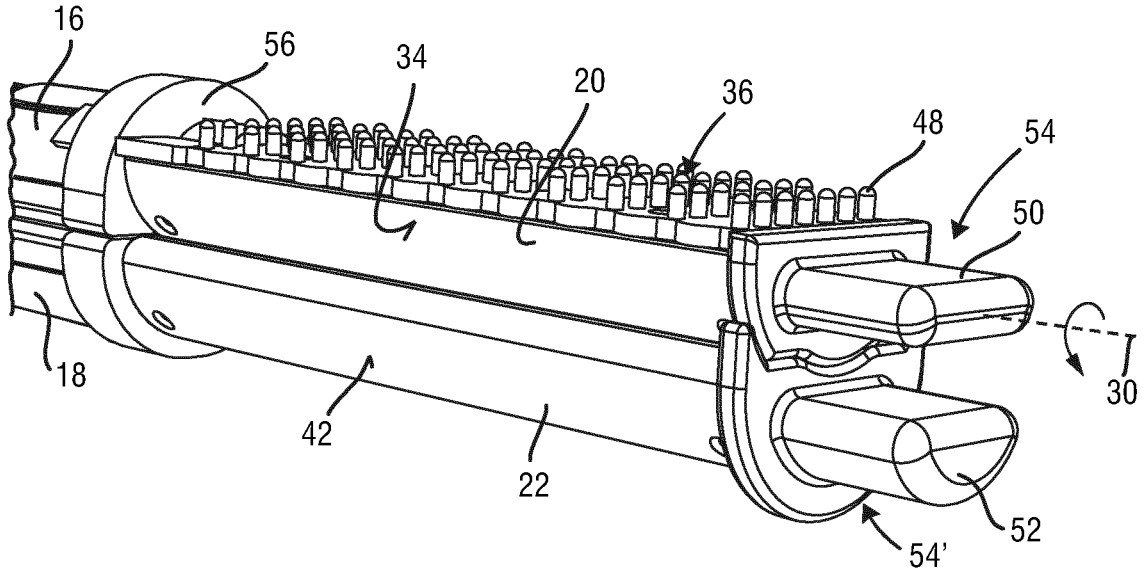
FIG. 4 shows enlarged views of the front portion of the hair care device in a second position.
Figure 4B:
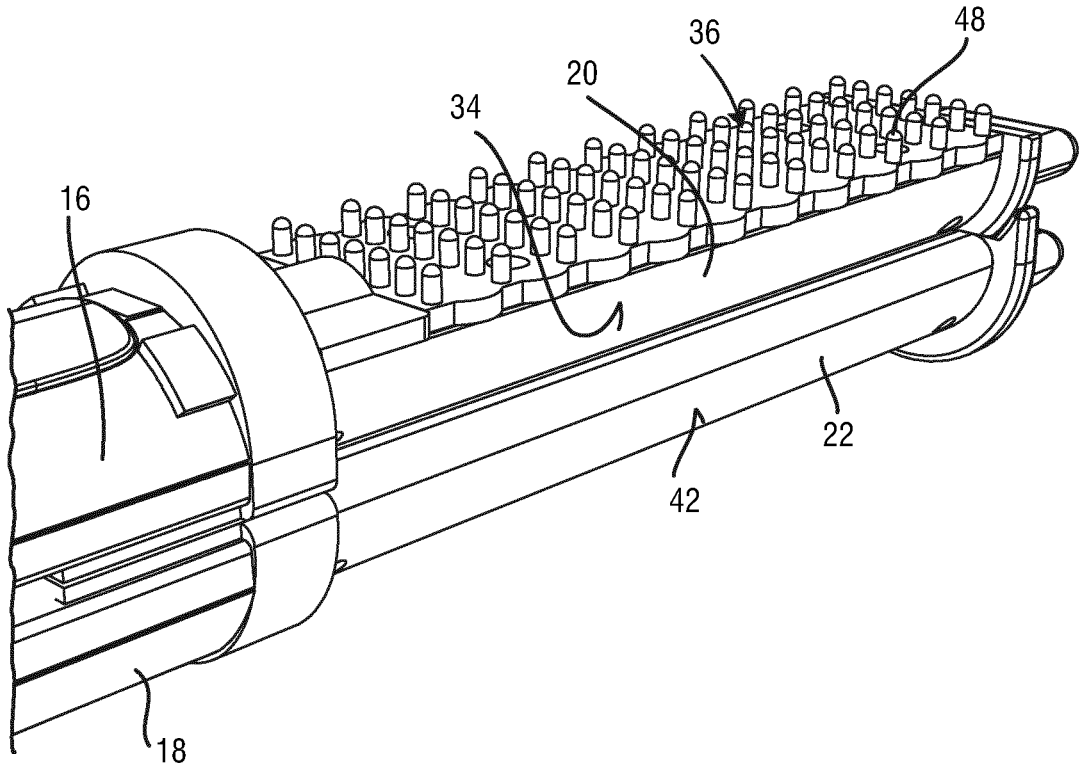

If the first heating tip 20 is rotated into its second position, which his illustrated in an enlarged view in FIGS. 4*a, b*, the bristle plate 36 then faces upwards, i.e. away from the second heating tip 22. The first heating surface 34 in this case faces towards the second heating tip 22, i.e. towards the third heating surface 44.

In the second position of the first heating tip 20 the device 10 may be used for two different types of hair styling. It may be either used for hair straightening, as this is schematically illustrated in FIG. 6*a*, or it may be used to create hair volume from the roots, as this is schematically illustrated in FIG. 6*c*.

Figure 6A:
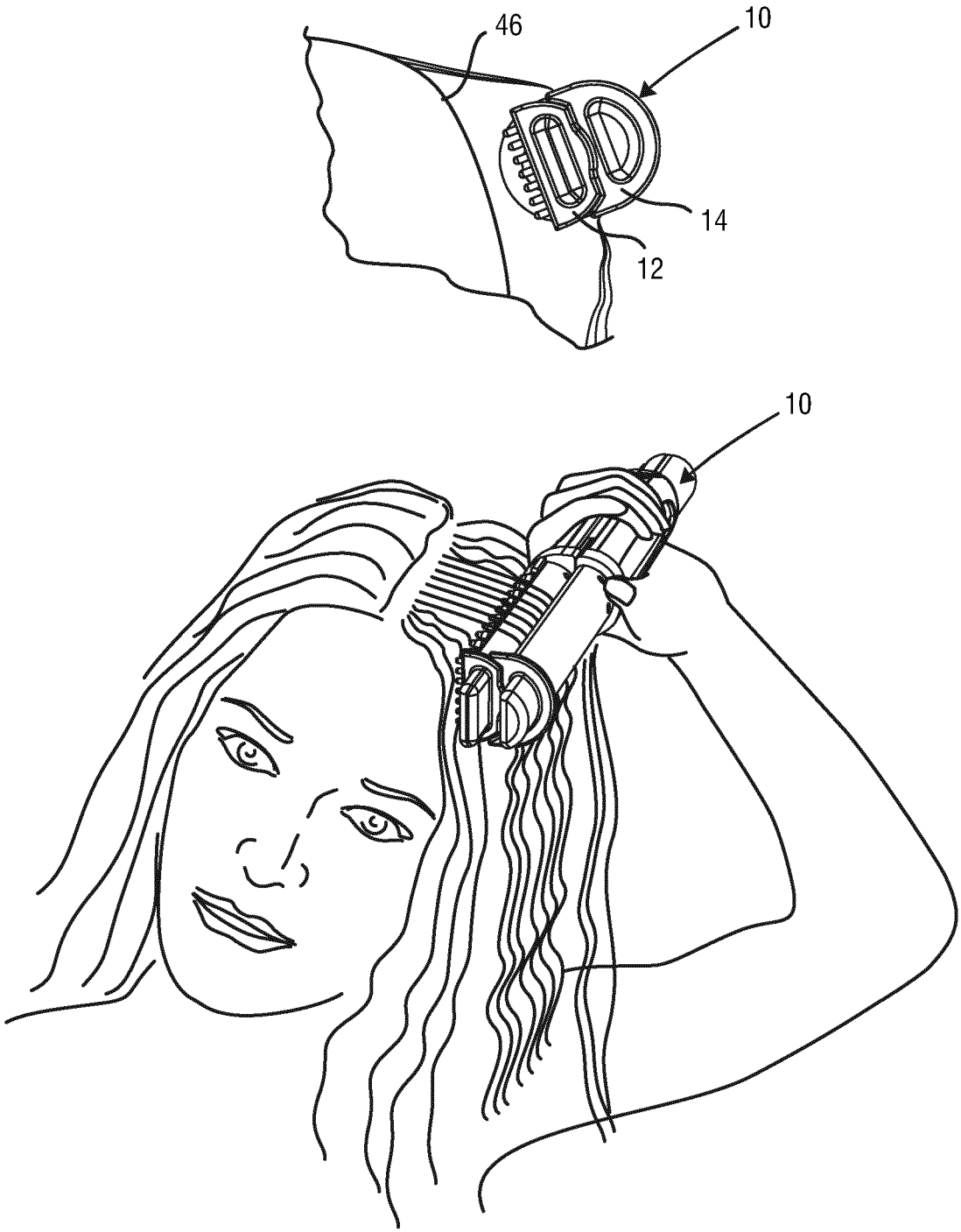
FIG. 6 shows different types of practical applications for which the hair care device may be used: straightening (FIG. 6*a*), curling (FIG. 6*b*) and volumizing (FIG. 6*c*)
Figure 6B:
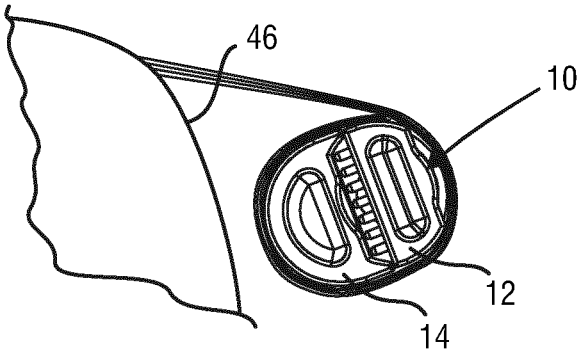
Figure 6B:
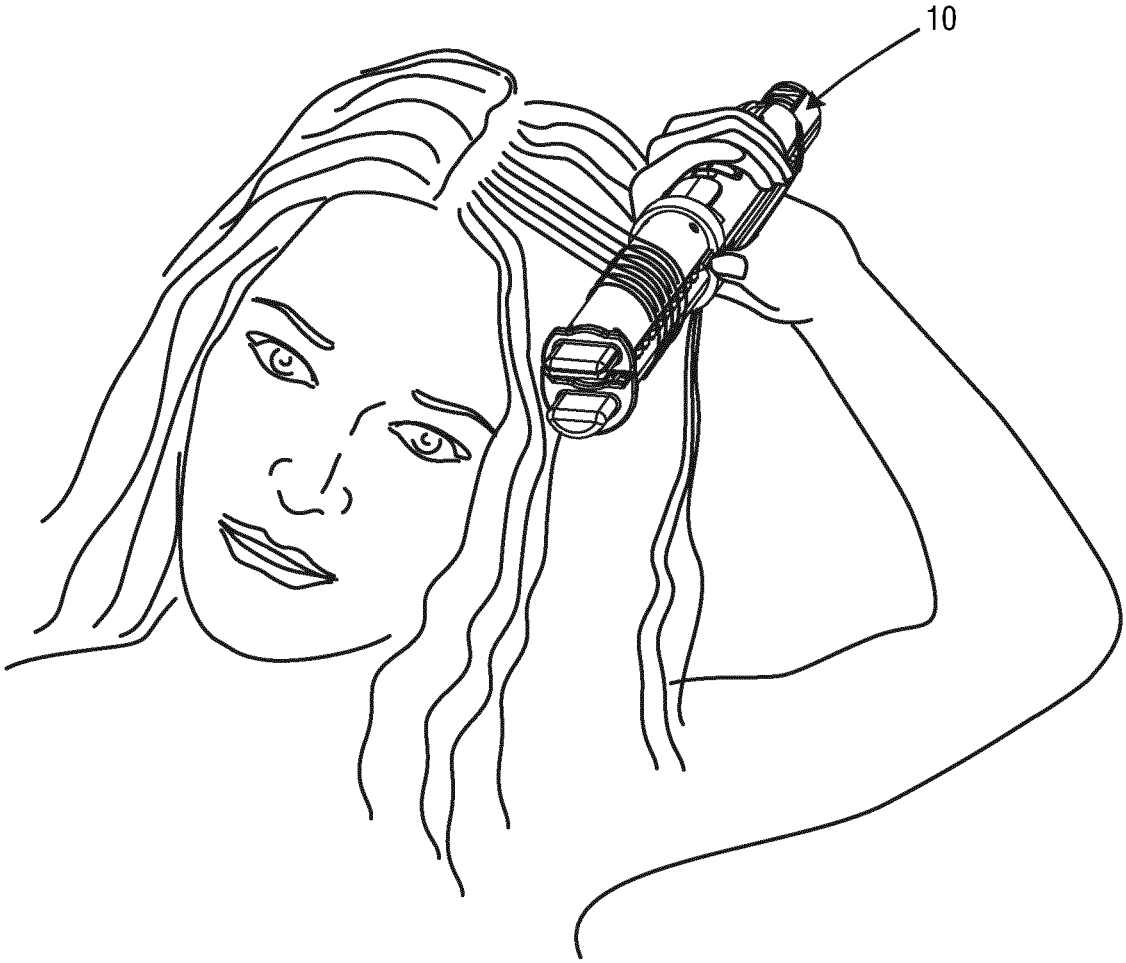
Figure 6C:
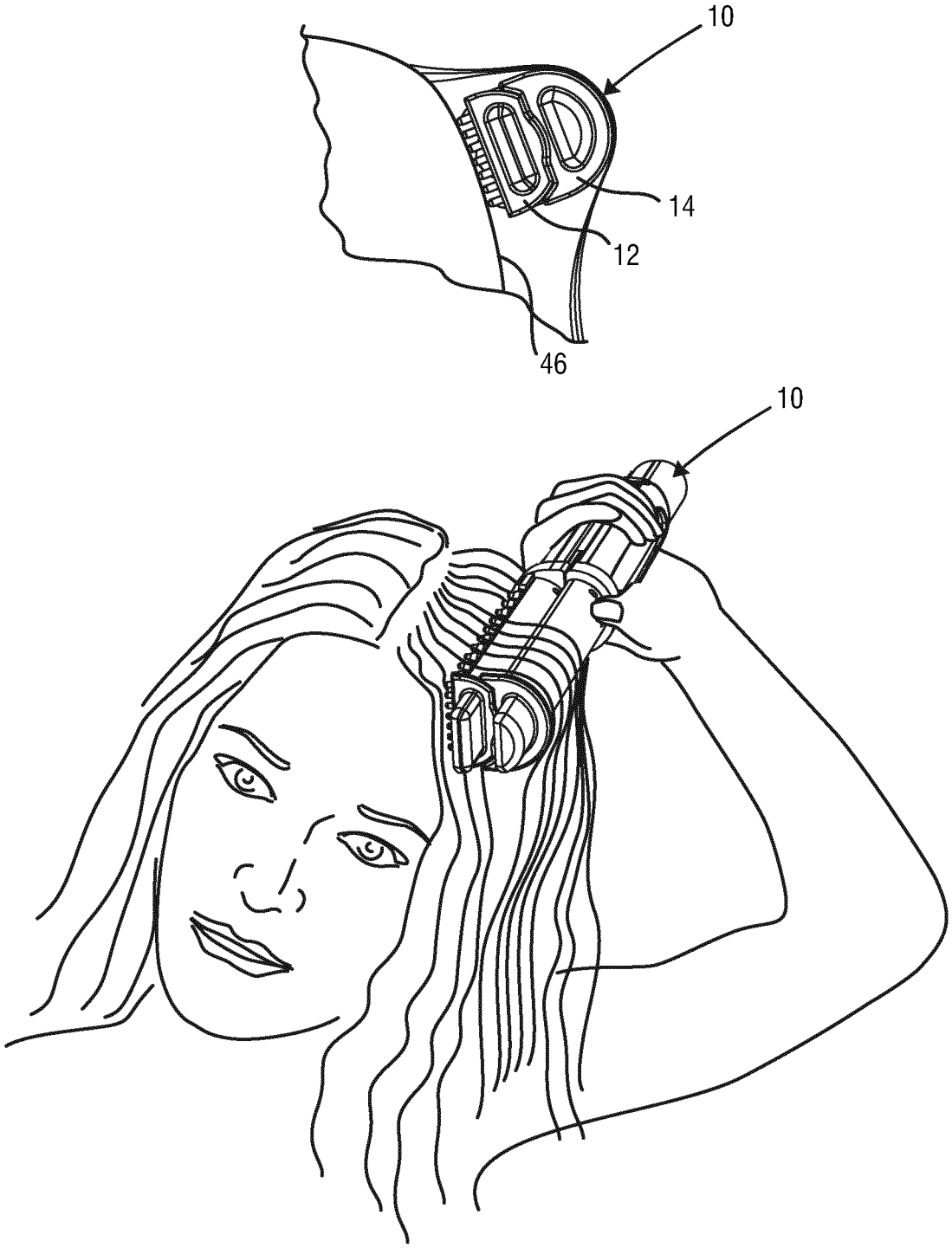

In order to use the device 10 as a hair straightener, hairs may be pinched hair strand by hair strand between the two jaws 12, 14, i.e. between the first and the third heating surface 34, 44 (see FIG. 6*a*). The two matching contours of the first and the second heating surface 34, 44 are in this case especially advantageous. Due to the convex- and concave-shaped heating surfaces 34, 44, the effective heating area that the hairs pass during straightening is enlarged compared to hair straighteners with flat heating plates. In FIG. 1*a* it may be also seen that only a part of the third heating surface 44, namely the middle part, has a concave shape. The lateral parts of the third heating surface 44, which adjoin said middle part on the left and right side, are instead preferably realized as planar surfaces. This is mainly to prevent kinking of the hairs that are to be straightened.

As already mentioned above, the hair care device 10 may be in the second position of the first heating tip 20 also be used as a volumizer. As illustrated in FIG. 6*c*, the user may then guide the device to the hair roots and let a hair strand hang over the second heating surface 42 of the second heating tip 22, while the device 10 contacts the scalp of the user with the bristles or ribs 40 of the bristle plate 36. The bristle plate 36 in this case acts as a kind of burning protection. The bristles or ribs 40 act as distance elements to the scalp 46 of the user, keeping the hot heating tips 20, 22 away from the user's scalp 46.

The bristle plate 36 is preferably made of a temperature-resistant synthetic material with very low heat conducting characteristics. In order to prevent that the bristle plate 36 becomes too hot, it may be in addition thermally insulated from the first heating tip 20. This may, for example, be realized by arranging a thermally insulating layer in between the first heat tip 20 and the bristle plate 36 (not shown). In this case there is no risk for a user to get burned. In order to create hair volume, the user may directly contact the scalp with the bristles or ribs 40. This enables to come very close to the scalp and to create hair volume starting from the hair roots. The user's comfort may be additionally increased by providing the bristles 40 with rounded tips 48 and making them at least partly flexible.

In summary, this means that the hair care device 10 in accordance with the invention may be used for three different kinds of hair styling appliances: hair straightening, hair curling and hair volumizing. Such a three-in-one device is not only very practical and easy in handling, but also less cost intensive than having to buy three different devices, one for each hair styling appliance.

In order to switch between the different modes, i.e. in order to rotate the first heating tip 20 as easy as possible, grip elements 50, 52 may be provided at the free end 54 of the two jaws 12, 14. A first grip element 50 is preferably provided at the free end 54 of the first heating tip 20. This first grip element 50 permits a user to rotate the first heating tip 20 relative to the first handle part 16. The free end 54 shall denote the end of the first heating tip 20 that is opposite to the end 56 at which the first heating tip 20 is connected to the first handle part 16.

The second grip element 52 is arranged at the free end 54' of the second heating tip 22. Both grip elements 50, 52 may also be denoted as "cool tips" as the grip elements 50, 52 are preferably thermally insulated from the hot heating tips 20, 22, such that they do not get heated in a too strong manner and the user may touch them without getting burned.

Figure 5A:
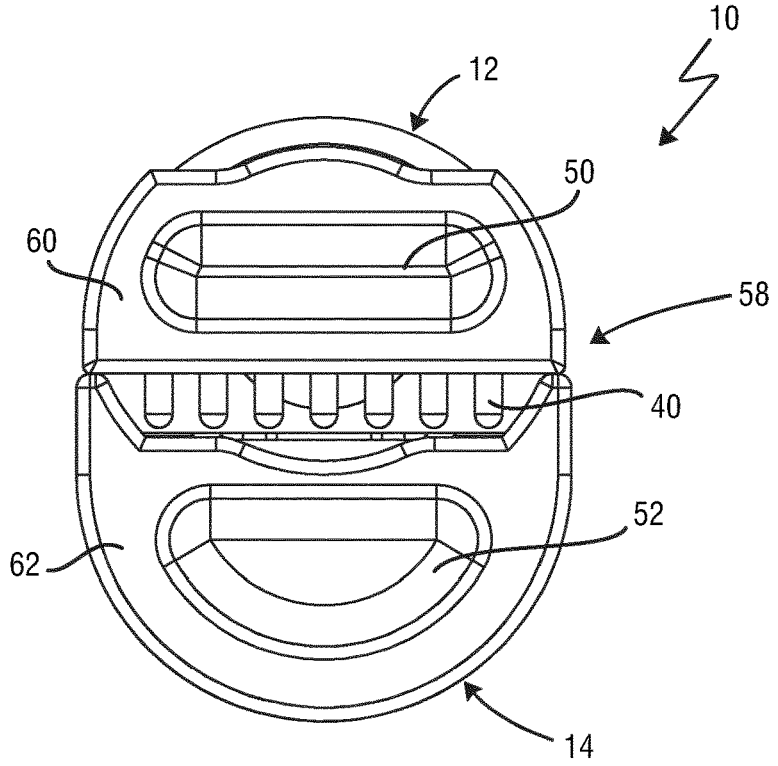
FIG. 5 shows top views from the front of the hair care device in the first position (FIG. 5*a*) and in the second position (FIG. 5*b*)
Figure 5B:
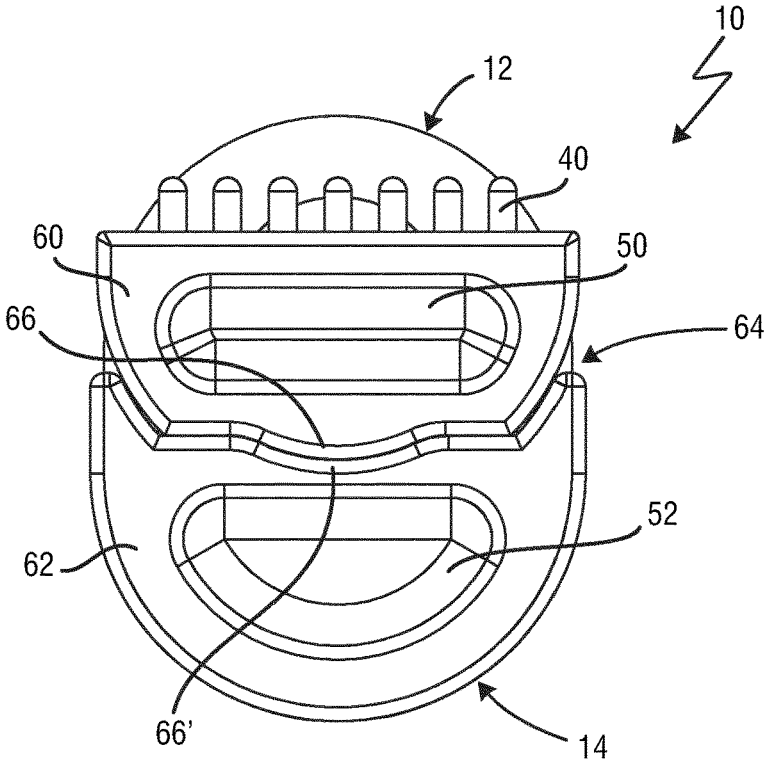

The grip elements 50, 52 may also be seen in the front views illustrated in FIGS. 5*a* and 5*b*. FIG. 5*a* shows the front of the device 10, wherein the first heating tip 20 is in its first position. FIG. 5*b* shows the front of the device 10, wherein the first heating tip 20 is in its second position. As it may be seen in FIGS. 5*a* and 5*b*, the device 10 additionally comprises a mechanical end stop element 58 that is configured to keep the bristles 40 of the bristle plate 36 at distance from the second heating tip 22, when the first heating tip 20 is in its first position and the jaws 12, 14 are in the closed position. In this position the bristles 40 do not contact the third heating surface 44 of the second heating tip 22. Otherwise the heating tips could get damaged. If the bristles 40 were heated in this position too strongly, this could also be dangerous for the user as soon as he/she rotates the first heating tip 20 into its second position and contacts his/her scalp with the bristles 40.

The mechanical end stop element 58 is preferably integrated into the grip elements 50, 52, as this is shown in FIG. 5*a*. The grip elements 50, 52 thereto comprise side walls 60, 62 which stick out of the sides of the grip elements 50, 52. These side walls 60, 62 do not only act as mechanical end stop element 58 in the above-mentioned manner, but also act as protective walls preventing a user to get into contact with the hot heating tips 20, 22 when touching the grip elements 50, 52.

A further function of these side walls 60, 62 is shown in FIG. 5*b*. They also act as a locking mechanism 64 for preventing a rotation of the first heating tip 20 relative to the first handle part 16, when the jaws 12, 14 are in the closed position and the first heating tip 20 is in its second position. This is realized by matching outer contours 66, 66', which are provided at the edge of the side walls 60, 62. The outer contours 66, 66' of the side walls 60, 62 mate each other, when the first heating tip 20 is arranged in its second position. An unintentional rotation of the first heating tip 20 is then effectively prevented.

It is noted that the outer contours 66, 66' may of course also be realized in a manner different than illustrated in FIG. 5*b*. The outer contours 66, 66' could be corrugated or waved. It could be also realized by a notch that is provided in one of the side walls 60, 62 and a corresponding fitting key that is provided in the other side wall 60, 62.

FIGS. 7*a*-7*c* and FIGS. 8*a*-8*c* show an alternative embodiment in which the bristle plate 36 comprises a plurality of retractable bristles. This prevents the bristles from becoming too hot in the position in which the bristles on the first jaw 12 face the second jaw 14, and it yields the additional advantage of a smaller gap at curling while maintaining the advantage of achieving sufficient distance to the scalp.

Figure 7A:
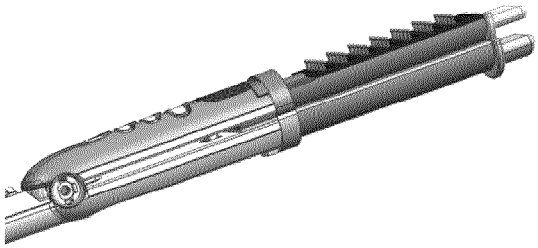
FIGS. 7*a*-7*c* and FIGS. 8*a*-8*b* show a first embodiment having retractable bristles.
Figure 7B:
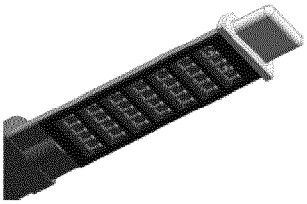
Figure 7C:
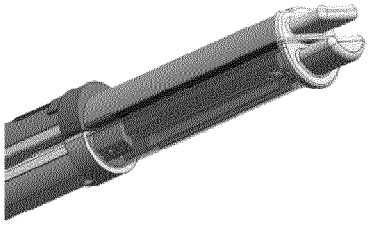

FIG. 7*a* shows the bristle plate with bristles in an active position, and FIG. 7*b* shows the bristle plate with the bristles in the refracted position. FIG. 7*c* shows the hair care device with the retracted bristles facing the second jaw 14.

Figure 8A:
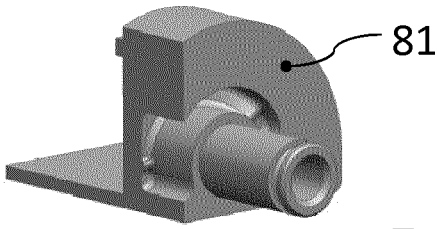
Figure 8A:
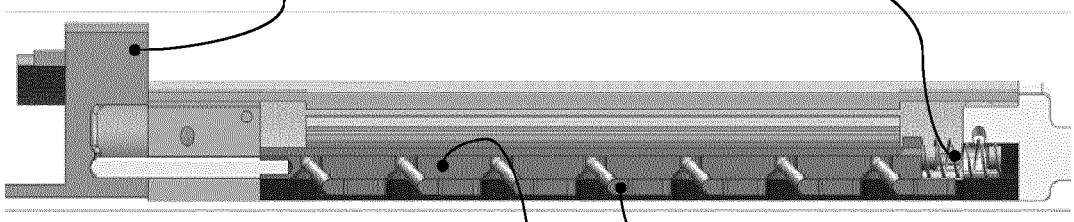
Figure 8B:
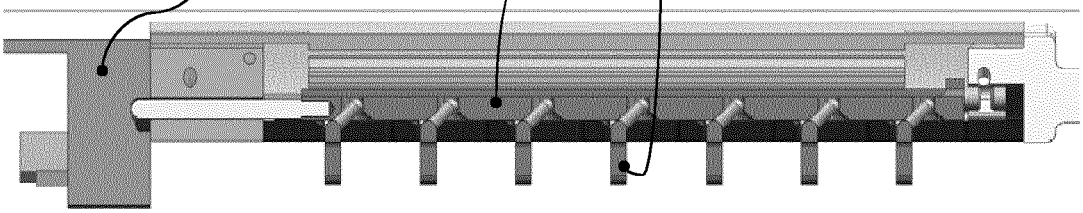

FIG. 8*a* shows a spiral grove of a bearing part 81. FIG. 8*b* shows a bristle activator 83 which is linear moveable (by about 5 mm). It is activated by the spiral grove of the bearing part 81 shown in FIG. 8*a*, around which the whole unit is rotating 180°. A spring 85 is pushing back the bristle activator 83, when turning back 180°. FIG. 8*c* shows that when the bristle activator 83 is moving forward, the bristles 87 will rotate out.

Figure 9A:
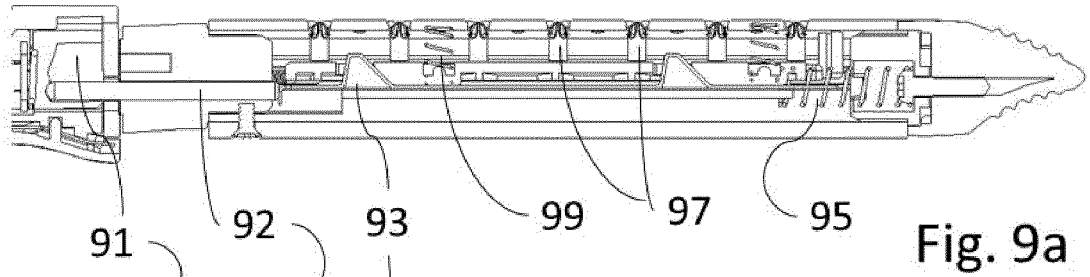
FIGS. 9*a*-9*b* show a second embodiment having retractable bristles.
Figure 9B:
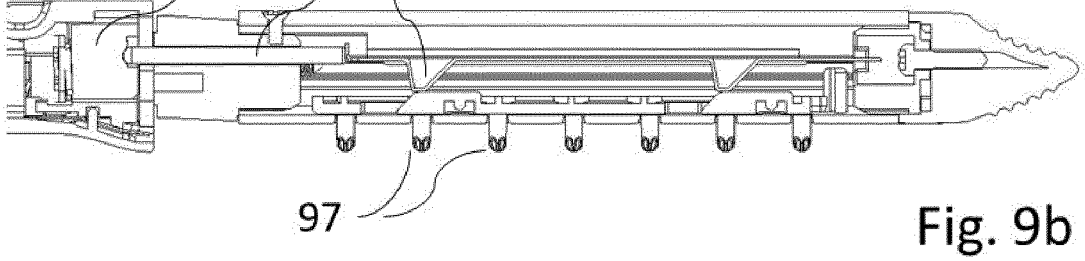

FIGS. 9*a*-9*b* show a second embodiment having retractable bristles, in which the bristles move out by a vertical translation instead of by a rotation. FIG. 9*a* shows the bristles in the retracted position, and FIG. 9*b* shows the bristles in the active position. Bearing part 91 is similar to the bearing part 81 shown in FIGS. 8*a*-8*c*. When the heating tip 20 is rotated, the bearing part 91 makes a first bristle activator part 92 move to the right, against a force applied by spring 95, resulting in a second bristle activator part 83 pushing the bristle plate upwards, against a force applied by spring 99, whereby bristles 97 are pushed through openings in the surface.

From the foregoing it is clear that the hair care device in accordance with the invention may be used for different types of styling needs. This may be done with one and the same device. Switching between the different styling modes is very easy to handle.

While the invention has been illustrated and described in detail in the drawings and foregoing description, such illustration and description are to be considered illustrative or exemplary and not restrictive; the invention is not limited to the disclosed embodiments but only by the independent claims. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A hair care device for straightening, curling and/or volumizing hair, the hair care device comprising:

a first jaw that extends along a first longitudinal axis and comprises a first handle part which is coupled to a first heating tip, wherein the first heating tip has a convex-shaped first heating surface;

distance elements that comprise a plurality of bristles or ribs arranged at and extending outwardly from a planar flat bottom surface of the first heating tip opposite the convex-shaped first heating surface; and a second jaw that extends along a second longitudinal axis and comprises a second handle part which is coupled to a second heating tip, wherein the first and the second jaw are coupled to each other, and via the handle parts moveable relative to each other between an open position and a closed position, and wherein the first heating tip is rotatably coupled to the first handle part to permit a user to rotate the first heating tip relative to first handle part about the first longitudinal axis to switch between (i) a first position for a curling mode in which the distance elements (i)(a) face towards, (i)(b) are kept at a distance away from, and (i)(c) do not contact the second heating tip in response to the first and the second jaws being in the closed position, and (ii) a second position for a straightening and volumizing mode in which the distance elements face away from the second heating tip and keep the first and second heating tips away from a user's scalp to prevent the user from getting burned.

2. The hair care device according to claim 1, wherein the distance elements further comprise a bristle plate that comprises the plurality of bristles or ribs outwardly extending from a flat surface of the bristle plate.

3. The hair care device according to claim 2, wherein the first heating tip is rotatable relative to the first handle part about the first longitudinal axis between a first position, in which the outwardly extending plurality of bristles or ribs of the bristle plate faces towards the second heating tip, and a second position, in which the outwardly extending plurality of bristles or ribs of the bristle plate faces away from the second heating tip.

4. The hair care device according to claim 2, wherein the bristle plate is thermally insulated from the first heating tip and comprises a temperature-resistant synthetic material.

5. The hair care device according to claim 2, wherein the bristles or ribs protrude from the bristle plate, and wherein a multitude of said bristles or ribs is flexible and comprises a rounded free end.

6. The hair care device according to claim 2, wherein the bristle plate comprises a plurality of retractable bristles which are retracted when the bristle plate faces the second jaw and which are not retracted when the bristle plate does not face the second jaw.

7. The hair care device according to claim 3, wherein the second jaw further comprises at least one mechanical end stop element at a free end of the second heating tip that is configured to keep the distance elements at a distance away from and not in contact with the second heating tip when (i) the first heating tip is in the first position and (ii) the first and the second jaws are in the closed position.

8. The hair care device according to claim 1, wherein the first and the second jaw are swivel-mounted relative to each other to permit a user to swivel the jaws relative to each other about a hinge axis between the open position and the closed position, wherein the hinge axis runs transverse to the first and second longitudinal axes.

9. The hair care device according to claim 1, wherein the first heating tip has a generally crescent shaped cross-section.

10. The hair care device according to claim 1, wherein the second heating tip comprises:

a convex-shaped second heating surface at a side that faces away from the first heating tip; and a third heating surface that faces towards the first heating tip and has at least in part a concave-shaped contour that matches an outer contour of the first heating surface of the first heating tip.

11. The hair care device according to claim 1, wherein the first jaw comprises a first grip element at a free end of the first heating tip to permit a user to rotate the first heating tip relative to the first handle part, wherein said free end of the first heating tip is opposite the end at which the first heating tip is connected to the first handle part.

12. The hair care device according to claim 11, wherein the first grip element is thermally insulated from the first heating tip and comprises a temperature-resistant synthetic material.

13. The hair care device according to claim 11, wherein the second jaw comprises a second grip element at a free end of the second heating tip, wherein said free end of the second heating tip is opposite the end at which the second heating tip is connected to the second handle part.

14. The hair care device according to claim 13, wherein at least one mechanical end stop element is arranged at one or more of the first and the second grip element.

15. The hair care device according to claim 13, wherein the first and second grip elements have matching outer contours, and wherein a locking mechanism for preventing a rotation of the first heating tip relative to the first handle part when the jaws are in the closed position, is realized by said matching outer contours that mate each other, when the first heating tip is in the second position and the jaws are in the closed position.

16. The hair care device according to claim 1, further comprising a locking mechanism for preventing a rotation of the first heating tip relative to the first handle part, when the first and the second jaws are in the closed position.

* * * * *